US007648947B2

(12) United States Patent
Yagishita

(10) Patent No.: US 7,648,947 B2
(45) Date of Patent: Jan. 19, 2010

(54) LUBRICATING OIL COMPOSITION FOR INTERNAL COMBUSTION ENGINE

(75) Inventor: Kazuhiro Yagishita, Kanagawa (JP)

(73) Assignee: Nippon Oil Corporation, Tokyo (JP)

( * ) Notice: Subject to any disclaimer, the term of this patent is extended or adjusted under 35 U.S.C. 154(b) by 317 days.

(21) Appl. No.: 10/525,902

(22) PCT Filed: Aug. 27, 2003

(86) PCT No.: PCT/JP03/10862

§ 371 (c)(1),
(2), (4) Date: Feb. 25, 2005

(87) PCT Pub. No.: WO2004/020558

PCT Pub. Date: Mar. 11, 2004

(65) Prior Publication Data

US 2005/0245402 A1 Nov. 3, 2005

(30) Foreign Application Priority Data

Aug. 27, 2002 (JP) ..... 2002-246836

(51) Int. Cl.
*C10M 105/78* (2006.01)
*C10M 133/56* (2006.01)
*C10M 159/20* (2006.01)

(52) U.S. Cl. ..... 508/185; 508/291; 508/460

(58) Field of Classification Search ..... 508/113, 508/185, 291, 460
See application file for complete search history.

(56) References Cited

U.S. PATENT DOCUMENTS

| | | | | |
|---|---|---|---|---|
| 5,498,809 | A * | 3/1996 | Emert et al. | 585/13 |
| 5,652,201 | A * | 7/1997 | Papay et al. | 508/228 |
| 6,008,165 | A * | 12/1999 | Shanklin et al. | 508/185 |
| 6,583,092 | B1 * | 6/2003 | Carrick et al. | 508/198 |
| 2003/0148895 | A1 * | 8/2003 | Robson et al. | 508/155 |
| 2003/0220209 | A1 * | 11/2003 | Curtis et al. | 508/551 |
| 2004/0242434 | A1 | 12/2004 | Yagishita et al. | |

FOREIGN PATENT DOCUMENTS

| | | | |
|---|---|---|---|
| EP | 89844 | A1 | 9/1983 |
| EP | 737735 | A2 | 10/1996 |
| EP | 1310548 | | 5/2003 |
| JP | 37-4423 | B1 | 6/1962 |
| JP | 62-501917 | | 7/1987 |
| JP | 62-243692 | | 10/1987 |
| JP | 62-253691 | | 11/1987 |
| JP | 63-304095 | | 12/1988 |
| JP | 63-304096 | | 12/1988 |
| JP | 1-500912 | | 3/1989 |
| JP | 6-41568 | | 2/1994 |
| JP | 11-080771 | A | 3/1999 |
| JP | 2000-63862 | | 2/2000 |
| JP | 2000-063865 | A | 2/2000 |
| JP | 2000-063871 | A | 2/2000 |
| JP | 2000-80388 | A | 3/2000 |
| JP | 2002-206096 | A | 7/2002 |
| JP | 2002-226882 | A | 8/2002 |
| JP | 2002-294271 | | 10/2002 |
| JP | 2003-183686 | | 7/2003 |
| WO | WO84/01169 | A1 | 3/1984 |
| WO | 02/062930 | A2 | 8/2002 |

* cited by examiner

*Primary Examiner*—Glenn Caldarola
*Assistant Examiner*—Jim Goloboy
(74) *Attorney, Agent, or Firm*—Ladas & Parry LLP

(57) ABSTRACT

The present invention provides a lubricating oil composition for an internal combustion engine which is very good in base number retention property, detergency at high temperature and valve train anti-wear property and does not substantially contain phosphorus- and/or sulfur-containing anti-wear agent. The composition comprises a lubricant base oil comprising a mineral oil and/or a synthetic oil, (A) 0.001 to 0.5% by mass of an ester of a boric acid in terms of boron element therein and (B) 0.01 to 5% by mass of an ashless antioxidant, wherein said composition contains substantially no metal salts of dithiophosphoric acid and has a sulfur content of 0.2% by mass or less, each percentage being based on a total mass of the composition.

9 Claims, No Drawings

LUBRICATING OIL COMPOSITION FOR INTERNAL COMBUSTION ENGINE

TECHNICAL FIELD

The present invention relates to a lubricating oil composition for an internal combustion engine, specifically a lubricating oil composition for an internal combustion engine which is good in long drain properties, detergency at high temperature and valve train wear prevention.

BACKGROUND ART

Hitherto, in order to make the life span of lubricating oil long, the following have been generally performed:

(1) a mineral type base oil is highly refined for the base oil thereof, and/or a synthetic oil such as poly-α-olefin or polyol ester is used as the base oil; and (2) as an additive therein, there are together used a peroxide decomposer such as zinc dialkyldithiophosphate (referred to as "ZDTP" hereinafter) and a chain terminator such as a phenolic type antioxidant. In particular, ZDTP is used as an anti-oxidation and anti-wear agent, and is used as an additive indispensable to current lubricating oil, particularly, lubricating oil for internal combustion engines.

However, sulfur-containing compounds such as ZDTP cause oxidation and deterioration of lubricating oil to be accelerated with sulfuric acid discharged in the process of the oxidation or thermal decomposition of the compounds themselves although the compounds are good in antioxidation. Therefore, it has been becoming clear that there is a limit in making the lifespan of such lubricating oil longer. In particular, in compositions containing a metal-based detergent, an ashless dispersant and so on, there was a tendency that the consumption (deterioration) of the total base number thereof, which is an index of acid-neutralizing property, is accelerated. It has been therefore becoming necessary to reconsider drastically the formulation of additives, the main of which is an anti-wear agent, in order to obtain a long drain type lubricating oil very good in oxidation stability.

Separately, it is imminently necessary to moderate, as much as possible, effect on exhaust gas catalysts, such as tree-way catalysts, oxidizing catalysts and NOx absorbing and reducing catalysts, which are equipped with internal combustion engines so as to cope with the latest environmental problem, or effect on exhaust gas after-treating devices such as a DPF (diesel particulate filter). Thus, low-phosphorus, low-sulfur or low-ash lubricating oil is also desired.

The Applicant was found out that a lubricating oil composition into which a specific phosphorus-containing anti-wear agent is incorporated, as a lubricating oil in which ZDTP is decreased or is not used, is good in long drain properties, detergency at high temperature and low frictional property while the composition keeps anti-wear property, and filed a patent application about a result thereof (for example, Japanese Patent Application Nos. 2002-015351, 2001-315941 and so on). However, there is a limit in a decrease in phosphorus in order to keep the anti-wear performance of valve trains which is equivalent to that in the case where a sulfur-containing compound, such as ZDTP, is used.

Separately, investigation has been hitherto made about low-phosphorus or phosphorus-free oils. Almost all thereof are oils comprising, as an essential component, a sulfur-containing anti-wear agent such as zinc dithiocarbamate instead of ZDTP in order to keep the anti-wear performance thereof (for example, Japanese Patent Application Laid-Open (JP-A) Nos. 62-253691, 6-41568, 1-500912, 63-304095, 63-304096, 62-243692, 62-501917, and 2000-63862). Sulfur-containing compounds as disclosed therein can keep the anti-wear performance and oxidation stability to some degree in the same manner as ZDTP, as described above. It is however difficult to make the long drain properties and detergency at high temperature higher. Consequently, it has been desired to develop novel engine oil in which phosphorus or sulfur is decreased or phosphorus and sulfur are not substantially contained.

DISCLOSURE OF THE INVENTION

In light of desires as described above, the present invention has been made. An object thereof is to provide a lubricating oil composition for an internal combustion composition which is very good in oxidation stability, long drain properties such as base number retention property, and detergency at high temperature. Another object of the invention is to provide a lubricating oil composition for an internal combustion engine in which phosphorus is not substantially contained and sulfur is deceased or is not substantially contained, thereby reducing the effect thereof on exhaust gas purifying treatment devices, particularly, exhaust gas purifying catalysts as much as possible.

The present inventor has made eager investigations and has found out that the above-mentioned problems can be solved by means of a composition comprising, in specific lubricant base oil, a boric acid ester and an ashless antioxidant and comprising therein substantially no metal salts of dithiophosphoric acid. Thus, the invention has been made.

Accordingly, the invention is a lubricating oil composition for an internal combustion engine, which comprises a lubricant base oil comprising a mineral oil and/or a synthetic oil, (A) 0.001 to 0.5% by mass of an ester of boric acid in terms of boron element therein and (B) 0.01 to 5% by mass of an ashless antioxidant, wherein said composition contains substantially no metal salts of dithiophosphoric acid and has a sulfur content of 0.2% by mass or less, each percentage being based on a total mass of the composition.

It is preferable that in the lubricating oil composition for an internal combustion engine, a total aromatic content and a sulfur content in the lubricating base oil are adjusted to 10% by mass or less and 0.05% by mass or less, respectively.

It is preferable that the lubricating oil composition for an internal combustion engine of the invention comprises (C) 0.005 to 1% by mass of metal-based detergent in terms of metal element therein, based on the total mass of the composition.

It is preferable that a metal ratio of the component (C) is 3 or less.

It is preferable that the component (C) is a metal-based detergent which contains substantially no sulfur.

It is preferable that the lubricating oil composition for an internal combustion engine of the invention comprises (D) 0.05 to 0.4% by mass of an ashless dispersant in terms of nitrogen element therein, based on the total mass of the composition.

It is preferable that the lubricating oil composition for an internal combustion engine of the invention contains substantially no phosphorous, and has a sulfur content of 0.05% by mass or less, based on the total mass of the composition.

It is preferable that the lubricating oil composition for an internal combustion engine of the invention is for an internal combustion engine using a fuel having a sulfur content of 50 ppm by mass or less.

BEST MODES FOR CARRYING OUT OF THE INVENTION

The lubricating oil composition for an internal combustion engine of the present invention is described in detail hereinafter.

As the lubricant base oil in the lubricating oil composition for an internal combustion engine of the invention, a mineral type base oil or synthetic type base oil can be used without any especial limit.

Specific examples of the mineral oil type base oil include oils obtained by refining a lubricating oil fraction yielded by distilling an atmospheric residue, which is obtained by distilling crude oil under normal pressure, under reduced pressure by at least one selected from solvent deasphalting, solvent extraction, hydrocracking, solvent dewaxing, hydrorefining and other treatments; wax-isomerized mineral oils; and base oils produced by isomerizing GTL wax (gas-to-liquid wax).

Specific examples of the synthetic type base oil include polybutene or hydrogenated products thereof; poly-α-olefins, such as 1-octene oligomer and 1-decene oligomer, or hydrogenated products thereof; diesters such as ditridecyl glutarate, di-2-ethylhexyl adipate, diisodecyl adipate, ditridecyl adipate and di-2-ethylhexyl cebacate; polyol esters such as neopentyl glycol ester, trimethylolpropane caprilate, trimethylolpropane pelargonate, pentaerythritol-2-ethyl hexanoate, and pentaerythritol pelargonate; and aromatic synthesis oils such as alkylnaphthalene, alkylbenzene, and aromatic esters; and mixtures thereof.

As the lubricant base oil in the invention, one out of the above-mentioned mineral oil type base oils, one out of the above-mentioned synthetic type base oils, or any mixture composed of two or more lubricating oils selected therefrom can be used. Examples thereof include one or more out of the mineral oil type base oils, one or more out of the synthetic type base oils, and a mixture of one or more out of the mineral oil type base oils and one or more out of the synthetic type base oils.

The total aromatic fraction content in the lubricant base oil in the invention is not particularly limited, and is adjusted preferably to 10% by mass or less, more preferably to 6% by mass or less, even more preferably to 3% by mass or less, and particularly preferably to 2% by mass or less. A composition for an internal combustion engine which is better in oxidation stability can be obtained by setting the total aromatic fraction content in the lubricant base oil to 10% by mass or less.

The above-mentioned total aromatic fraction content means the content of aromatic fractions measured in accordance with ASTM D2549. The aromatic fractions usually include alkylbenzenes, alkylnaphthalenes; anthracene, phenanthlene, and alkylated products thereof; compounds in which 4 or more benzene rings are condensed; compounds having a hetero aromatics, such as pyridines, quinolines, phenols and naphthols; and others.

The sulfur content in the lubricant base oil is not particularly limited, and is adjusted preferably to 0.05% by mass or less, more preferably to 0.01% by mass or less, and particularly preferably to 0.005% by mass or less. A low-sulfur lubricating oil composition which is better in long drain properties and produces a bad effect on exhaust gas purifying catalysts as little as possible can be obtained by decreasing the sulfur content in the lubricant base oil.

The kinematic viscosity of the lubricant base oil used in the invention is not particularly limited, and the kinematic viscosity thereof at 100° C. is preferably 20 $mm^2/s$ or less, more preferably 10 $mm^2/s$ or less. On the other hand, the kinematic viscosity is preferably 1 $mm^2/s$ or more, more preferably 3 $mm^2/s$ or more, and particularly preferably 4 $mm^2/s$ or more. If the kinematic viscosity of the lubricant base oil is 20 $mm^2/s$ or more at 100° C., the viscometric property at low temperature deteriorates. On the other hand, if the kinematic viscosity is less than 1 $mm^2/s$, an oil film is insufficiently formed at lubricating spots so that poor lubricity may be given and further the evaporation loss of the lubricant base oil becomes large. Thus, these cases are each not preferred.

The evaporation loss of the lubricant base oil is not particularly limited and is 20% by mass or less, more preferably 16% by mass or less, and particularly preferably 10% by mass or less as measured by NOACK evaporation analysis. If the NOACK evaporation loss of the lubricant base oil is more than 20% by mass, the evaporation loss of the lubricating oil is large. Moreover, sulfur compounds or metals in the composition may be deposited, together with the lubricant base oil, on an exhaust gas purifying device. Thus, a bad effect on the exhaust gas purifying performance thereof is unfavorably feared. The NOACK evaporation loss referred to herein is a value obtained by keeping 60 g of a lubricating oil sample at 250° C. and a pressure resulting from a reduction of 20×9.80665 Pa from normal pressure (20 $mmH_2O$) for 1 hour and measuring the evaporation therefrom after the keeping in accordance with CEC L-40-T-87.

The viscosity index of the lubricant base oil is not particularly limited, and the value is preferably 80 or more, more preferably 100 or more, and even more preferably 120 or more to obtain good viscometric property at temperatures from low temperature and high temperature. If the viscosity index is less than 80, the viscometric property unfavorably deteriorates at low temperature.

The component (A) in the lubricating oil composition for an internal combustion engine of the invention is a boric acid ester. In general, the boric acid ester is usually used, as a shaft bearing corrosion inhibitor, together with a sulfur-and/or phosphorus-containing compound (for example, JP-A No.s 63-304095, 63-304096, 2000-63865, and 2000-63871). Recently, it has understood that the boric acid ester has an effect for heightening the frictional coefficient between metals (JP-A No. 2002-226882).

Examples of the boric acid ester in the invention include compounds represented by the following general formula (1) or (2), and derivatives thereof.

(1)

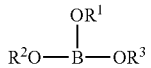

(2)

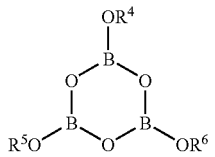

In the general formulae (1) and (2), $R^1$ to $R^6$ each independently represent a hydrocarbon group having 1 to 30 carbon atoms, and may be the same or different.

Specific examples of the hydrocarbon group having 1 to 30 carbon atoms include alkyl groups which have 1 to 30 carbon atoms (and may be linear or branched) such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups; alkenyl groups which have 2 to 30 carbon atoms (and may be linear or branched, the position of the double bond therein being arbitrary) such as ethenyl, propenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl groups; cycloalkyl groups having 5 to 7 carbon atoms such as cyclopentyl, cyclohexyl and cycloheptyl groups; alkylcycloalkyl groups having 6 to 11 carbon atoms (the position(s) where the alkyl group(s) is/are substituted on the cycloalkyl group being arbitrary) such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups; aryl groups which have 6 to 18 carbon atoms such as phenyl and naphthyl groups; alkylaryl groups having 7 to 26 carbon atoms (in which the alkyl group(s) may be linear or branched, the position(s) where the alkyl group(s) is/are substituted on the aryl group beingarbitrary) such as tolyl, xylyl, ethylphenyl, propylphenyl, butylphenyl, pentylphenyl, hexylphenyl, heptylphenyl, octylphenyl, nonylphenyl, decylphenyl, undecylphenyl, dodecylphenyl, diethylphenyl, dibutylphenyl, and dioctylphenyl groups; and arylalkyl groups which have 7 to 12 carbon atoms (in which the alkyl group may be linear or branched) such as benzyl, phenylethyl, phenylpropyl, phenylbutyl, phenylpentyl, and phenylhexyl groups.

The hydrocarbon group having 1 to 30 carbon atoms is preferably a hydrocarbon group having 2 to 24 carbon atoms, more preferably a hydrocarbon group having 3 to 20 carbon atoms. More specifically, the hydrocarbon group is preferably an alkyl group having 1 to 30 carbon atoms or an aryl group having 6 to 24 carbon atoms, more preferably an alkyl group having 3 to 18 carbon atoms, even more preferably an alkyl group having 4 to 12 carbon atoms.

The boric acid ester represented by the general formula (1) is usually obtained by causing 3 moles of the above-mentioned alcohol having 1 to 30 carbon atoms to react with 1 mole of orthoboric acid ($H_3BO_3$).

The boric acid ester represented by the general formula (2) is usually obtained by causing 1 moles of the above-mentioned alcohol having 1 to 30 carbon atoms to react with 1 mole of orthoboric acid ($H_3BO_3$).

Conditions for these reactions are not particularly limited. Usually, the reactions are conducted at 100° C. or higher. The conditions are particularly preferable since generated water can be simultaneously removed.

Examples of the derivative of the component (A) include compounds which neither contain phosphorus nor sulfur among organic borates described in JP-A No. 2002-226882, for example, organic borate/polyamine condensates (polyamine condensates of the above-mentioned boric acid ester) and organic borate/polyol condensates (polyol condensates of the above-mentioned boric acid ester). Specific and preferable examples of the component (A) include triethyl borate, tri-n-propyl borate, triisopropyl borate, tri n-butyl borate, tri sec-butyl borate, tri tert-butyl borate, trihexyl borate, trioctyl borate, tridecyl borate, tridodecyl borate, trihexadecyl borate, trioctadecyl borate, triphenyl borate, tribenzyl borate, triphenetyl borate, tritolyl borate, triethylphenyl borate, tripropylphenyl borate, tributylphenyl borate, and trinonylphenyl borate. Of these, particularly preferable are tri n-butyl borate, trioctyl borate and tridodecyl borate.

The lower limit of the content of the component (A) in the lubricating oil composition for an internal combustion engine of the invention is 0.001% by mass or more, preferably 0.01% by mass or more, particularly preferably 0.04% by mass or more of the total of the composition, the content being a content in terms of the boron element therein. The upper limit of the component (A) therein is usually 0.5% by mass or less, preferably 0.2% by mass or less, more preferably 0.1% by mass or less of the total of the composition, the content being a content in terms of the boron element. If the content of the component (A) is more than the upper limit, anti-wear effect corresponding to the content cannot be unfavorably obtained with ease.

The component (B) in the lubricating oil composition for an internal combustion engine of the invention is an ashless antioxidant. Any ashless antioxidant that is generally used in lubricating oil, such as a phenol type antioxidant or amine type antioxidant, can be used.

Preferable examples of the phenol type antioxidant include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol, 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4-(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl) sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, and 3-methyl-5-tert-butyl-4-hydroxyphenyl-substituted aliphatic acid esters such as octyl-3-(3-methyl-5-tert-butyl-4-hydroxyphenyl) propionate. These may be used in the form of a mixture of two or more thereof. Of these, compounds containing no sulfur are particularly preferable.

Examples of the amine type antioxidant include phenyl-α-naphthylamine, alkylphenyl-α-naphthylamine, and dialkylphenylamine. These may be used in the form of a mixture of two or more thereof.

A combination of the above-mentioned phenol type antioxidant and amine type antioxidant may be incorporated.

When the component B) is incorporated into the lubricating oil composition for an internal combustion engine of the invention, the content thereof is usually 5% by mass or less, preferably 3% by mass or less, more preferably 2.5% by mass or less of the total of the composition. If the content is more than 5% by mass, sufficient antioxidation corresponding to the incorporated amount is not unfavorably obtained. On the other hand, the lower limit of the content is 0.01% by mass or more, preferably 0.1% by mass or more, particularly preferably 0.5% by mass or more of the total of the composition in order to obtain sufficient antioxidation.

Metal salts of dithiophosphoric acid are not substantially contained in the lubricating oil composition for an internal combustion engine of the invention. Examples of the metal salt of dithiophosphoric acid include not only zinc dithiophosphate but also salts of dithiophosphoric acid and various metals such as metals in the I groups, metals in the II group, aluminum, lead, tin, manganese, cobalt, nickel, and copper. The wording "metal salts of dithiophosphoric acid are not substantially contained" herein means the following amount when these only are used: an amount which makes it impossible to exhibit the anti-wear performance of a valve train more satisfactorily than the composition into which the component (A) is incorporated in an amount of 0.05% by mass of the total of the composition, this amount being an amount in terms of the boron element therein, and further which does not remarkably block the advantageous effects of the invention. The amount in terms of the phosphorus element therein is, for example, 0.04% by mass or less, preferably 0.01% by mass or less, particularly preferably 0.001% by mass or less of the total of the composition. The wording essentially means that these are not incorporated at all on purpose.

The lubricating oil composition for an internal combustion engine of the invention comprises the above-mentioned constituents, whereby the composition becomes good in wear-prevention performance of a valve train and very good in oxidation stability. Further incorporation of (C) a metal-based detergent and (D) an ashless dispersant thereinto makes it possible to yield a composition having better antioxidation and very good base number retention property and detergency at high temperature.

As the component (C) in the lubricating oil composition for an internal combustion engine of the invention, any compound that is used as a metal-based detergent for lubricating oil can be used. Specific examples thereof include one or more metal-based detergent selected from alkali metal or alkaline earth metal sulfonate, alkali metal or alkaline earth metal phenate, alkali metal or alkaline earth metal salicylate, and alkali metal or alkaline earth metal carboxylate. It is preferable to use, as an essential component, alkali metal or alkaline earth metal phenate, alkali metal or alkaline earth metal salicylate, or alkali metal or alkaline earth metal carboxylate which contains no sulfur, and it is particularly preferable to use the alkali metal or alkaline earth metal salicylate since a lubricating oil composition can be obtained which is good in oxidation stability, base number retention property and detergency at high temperature and which has a low sulfur content or does not substantially contain sulfur.

The alkali metal or alkaline earth metal sulfonate is an alkali metal or alkaline earth metal salt, in particular a magnesium salt and/or calcium salt, of alkyl aromatic sulfonic acid, which is obtained by sulfonating an alkyl aromatic compound having a molecular weight of 1300 to 1500, preferably 400 to 700. The calcium salt is preferably used.

The above-mentioned alkyl aromatic sulfonic acid may be specifically the so-called petroleum sulfonic acid, synthetic sulfonic acid or the like. As the petroleum sulfonic acid referred to herein, the following is generally used: a sulfonated alkyl aromatic compound of a lubricating oil fraction of a mineral oil; the so-called mahogany acid, which is yielded as a byproduct at the time of producing white oil (liquid paraffin); or some other acid. As the synthetic sulfonic acid, for example, the following is used: a sulfonated alkylbenzene having a linear or branched alkyl group, which is yielded as a byproduct from production plants for alkylbenzene, which is a raw material for detergents, or which is yielded by alkylating a polyolefin into benzene; a sulfonated alkylnaphthalene such as dinonylnaphthalene; or some other sulfonic acid. As a sulfonating agent for sulfonating these alkyl aromatic compounds, fuming sulfuric acid or sulfuric anhydride is usually used.

Examples of the alkali metal or alkaline earth metal phenate include alkali or alkaline earth metal salts, in particular magnesium salts and/or calcium salts, of Mannich reaction products of alkylphenols, alkylphenol sulfides or alkylphenols having a linear or branched alkyl group which has 4 to 30 carbon atoms, preferably 6 to 18 (and may be primary, secondary or tertiary). Particularlypreferable are alkali metal or alkaline earth metal phenates containing no sulfur.

Examples of the alkali metal or alkaline earth metal salicylate include alkali or alkaline earth metal salts, in particular magnesium salts and/or calcium salts, of salicylic acids having one or two hydrocarbon groups having 1 to 40 carbon atoms. Examples thereof include compounds represented by the following general formula (3):

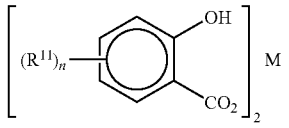

(3)

wherein $R^{11}$ represents a hydrocarbon group having 1 to 40 carbon atoms, preferably 1 to 30, and is preferably an alkyl group; M represents an alkaline earth metal, and is preferably calcium or magnesium, particularly preferably calcium; and n is 1 or 2.

Specific examples of $R^{11}$ include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, dococyl, tricocyl, tetracocyl, pentacocyl, hexacocyl, heptacocyl, octacocyl, nonacocyl and triacontyl groups. These may be linear or branched, and may be a primary, secondary or tertiary alkyl group.

Examples of the alkali metal or alkaline earth metal sulfonate, the alkali metal or alkaline earth metal phenate, the alkali metal or alkaline earth metal salicylate or the like also include neutral salts obtained by causing the above-mentioned alkyl aromatic sulfonic acid, alkylphenol, alkylphenol sulfide, a Mannich reaction product of alkylphenol, alkylsalicylic acid or the like to react directly with an alkaline earth metal base such as an oxide or hydroxide of one or two alkaline earth metals of magnesium and/or calcium, by turning the above-mentioned compound into an alkali metal salt such as a sodium salt or potassium salt, or by substituting the resultant alkali metal salt with an alkaline earth metal salt; and further include basic salts obtained by heating one or more out of the neutral salts together with an excessive amount of an alkaline earth metal or alkaline earth metal salt or an alkaline earth metal or alkaline earth metal base in the presence of water, and perbasic salts obtained by causing one or more out of the neutral salts to react a base of an alkaline earth metal in the presence of carbon dioxide gas, boric acid or a boric acid salt.

As the metal-based detergent referred to in the invention, the above-mentioned neutral salt, basic salt, perbasic salt and a mixture thereof can be used.

Usually, the metal-based detergent is put on the market or is available in the state that the detergent is diluted with a light lubricant base oil or the like. In general, it is desired that the metal content therein is from 1.0 to 20% by mass, preferably from 2.0 to 16% by mass.

The total base number of the component (C) in the invention is usually from 0 to 500 mgKOH/g, preferably from 20 to 450 mgKOH/g. One or more from these may be used or used together. The total base number referred to herein means the total base number which is according to the potentiometric titration (base number/perchloric acid method) and is measured in accordance with JIS K 2501 in "Petroleum Products and Lubricating Oil—Neutralization Number Test Method, 7."

About the component (C) of the invention, the metal ratio thereof is not particularly limited. Usually, a single or a mixture of two or more selected from components having a metal ratio of 20 or less can be used. A metal-based detergent the metal ratio of which is preferably 3 or less, more preferably 1.5 or less, particularly preferably 1.2 or less is used as an essential component since the oxidation stability, base number retention property, high-temperature detergency and other properties thereof are good. The metal ratio referred to herein is represented by (the valence of metal elements in any metal-based detergent)×(the content (% by mol) of the metal elements)/(the content (% by mol) of soap groups therein). The metal elements mean calcium, magnesium and other metals, and the soap groups mean sulfonic acid and salicylic acid groups and other groups.

The component (C) content in terms of metal elements in the invention is usually from 1% by mass or less, preferably 0.5% by mass or less, more preferably 0.4% by mass or less, and the content is preferably set to 0.3% by mass or less in order to decrease the sulfated ash content in the composition into 1.0% by mass or less. The component (C) content is 0.005% by mass or more, preferably 0.01% by mass or more, and is more preferably 0.05% by mass or more in order to make higher the oxidation stability, base number retention property and high-temperature detergency. The content is particularly preferably set to 0.2% by mass or more, thereby making it possible to yield a composition capable of maintaining the base number and the high-temperature detergency for a long term. The sulfated ash content referred to herein means a value measured by the method prescribed in JIS K 2272 5. "Sulfated Ash Content Test Method", and results mainly from metal-containing additives.

As the (D) ashless dispersant, any ashless dispersant that is used in lubricating oil can be used. Examples thereof are nitrogen-containing compounds having in a single molecule thereof at least one linear or branched alkyl or alkenyl groups having 40 to 400 carbon atoms, or derivatives thereof; or modified products of alkenylsuccinimide. One or more selected therefrom at will can be incorporated.

The carbon number of this alkyl or alkenyl group is from 40 to 400, preferably from 60 to 350. If the carbon number of this alkyl or alkenyl group is less than 40, the solubility of the compound in the lubricant base oil lowers. On the other hand, if the carbon number of the alkyl or alkenyl group is more than 400, the low-temperature fluidity of the lubricating oil composition for an internal combustion engine deteriorates. Thus, these cases are not each preferred. This alkyl or alkenyl group may be linear or branched. Specific and preferable examples thereof include branched alkyl groups and branched alkenyl groups derived from oligomers of olefins such as propylene, 1-butene and isobutylene or from cooligomers of ethylene and propylene.

Specific examples of the component (D) include compounds described below. One or more compounds selected therefrom can be used.

(D-1) succinimide having in the molecule thereof at least one alkyl or alkenyl group having 40 to 400 carbon atoms, or derivatives thereof;

(D-2) benzylamine having in the molecule thereof at least one alkyl or alkenyl group having 40 to 400 carbon atoms, or derivatives thereof; and (D-3) polyamine having in the molecule thereof at least one alkyl or alkenyl group having 40 to 400 carbon atoms, or derivatives thereof;

More specific examples of the (D-1) succinimide include compounds represented by the following formula (4) or (5):

(4)

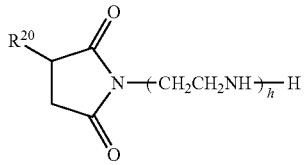

wherein $R^{20}$ represents an alkyl or alkenyl group having 40 to 400 carbon atoms, preferably 60 to 350 carbon atoms, and h represents an integer of 1 to 5, preferably 2 to 4, and (5)

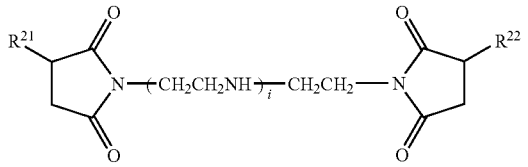

wherein $R^{21}$ and $R^{22}$ each independently represent analkyloralkenyl group having 40 to 400 carbon atoms, preferably 60 to 350 carbon atoms, and are each preferably a polybutenyl group, and i represents an integer of 0 to 4, preferably 1 to 3.

Succinimide is classified into the so-called mono type succinimide represented by the formula (4), in which a succinic anhydride is added to one end of a polyamine, and the so-called bis type succinimide represented by the formula (5), wherein succinic anhydrides are added to both ends of a polyamide. The composition of the invention may comprise either of them, or a mixture of them.

The process for producing the succinimide is as follows: the succinimide can be yielded by causing a polyamine to react with a polybutenylsuccinic acid obtained by causing maleic anhydride to react with a compound having an alkyl or alkenyl group having 40 to 400 carbon atoms, for example, a poly(iso)butene having a number-average molecular weight of 700 to 3500, preferably 900 to 2500. Specific examples of the polyamine include diethylenetriamine, triethylenetetramine, tetraethylenepentamine, and pentaethylenehexamine.

More specific examples of the (D-2) benzylamine include compounds represented by the following formula (6):

(6)

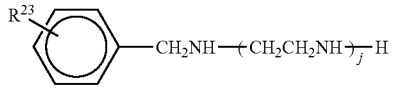

wherein $R^{23}$ represents an alkyl or alkenyl group having 40 to 400 carbon atoms, preferably 60 to 350 carbon atoms, and j represents an integer of 1 to 5, preferably 2 to 4.

The process for producing the benzylamine is as follows: the benzylamine can be yielded by causing phenol to react with a polyolefin, such as propylene oligomer, polybutene or ethylene/α-olefin copolymer, to produce an alkylphenol, and then causing this to react with formaldehyde and a polyamine (such as diethylenetriamine, triethylenetetramine, tetraethylenepentamine, or pentaethylenehexamine) by Mannich reaction.

More specific examples of the (D-3) polyamine include compounds represented by the following formula (7):

$$R^{24}—NH-(CH_2CH_2NH)_kH \quad (7)$$

wherein $R^{24}$ represents an alkyl or alkenyl group having 40 to 400 carbon atoms, preferably 60 to 350 carbon atoms, and k represents an integer of 1 to 5, preferably 2 to 4.

The process for producing the polyamine is as follows: the polyamine can be yielded by chlorinating a polyolefin, such as propylene oligomer, polybutene or ethylene/α-olefin copolymer, and then causing this to react with a polyamine (such as ammonia, ethylenediamine, diethylenetriamine, triethylenetetramine, tetraethylenepentamine, or pentaethylenehexamine).

Examples of the derivatives of the nitrogen-containing compounds, the derivatives being given as examples of the component (D), include the so-called acid-modified compounds obtained by causing a monocarboxylic acid (such as aliphatic acid) having 1 to 30 carbon atoms, a polycarboxylic acid having 2 to 30 carbon atoms such as oxalic acid, phthalic acid, trimellitic acid or pyromellitic acid, a hydroxy (poly) alkylene carbonate, or some other compound to act on the above-mentioned nitrogen-containing compounds, and then neutralizing or amidating a part or the whole of remaining amino groups and/or imino groups; the so-called boron-modified compounds obtained by causing boric acid to act on the above-mentioned nitrogen-containing compounds, and then neutralizing or amidating a part or the whole of remaining amino groups and/or imino groups; the so-called phosphorus-modified compounds obtained by causing phosphoric acid to act on the above-mentioned nitrogen-containing compounds, and then neutralizing or amidating a part or the whole of remaining amino groups and/or imino groups; sulfur-modified compounds obtained by causing a sulfur compound to act on the above-mentioned nitrogen-containing compounds; and modified compounds wherein the above-mentioned nitrogen-containing compounds are combined with two or more kinds of modifications selected from acid modification, boron modification, phosphoric acid modification and sulfur modification. Of these derivatives, boric-acid-modified compounds of polybutenylsuccinimide are good in heat resistance, antioxidation and are effective for making higher the wear prevention and make higher base number retention property, high-temperature detergency and wear prevention of the lubricating oil composition for an internal combustion engine of the invention also.

When the component (D) is incorporated into the lubricating oil composition for an internal combustion engine of the invention, the content thereof is usually 0.01% by mass or more, preferably 0.05% by mass or more, more preferably 0.07% by mass or more and is 0.4% by mass or less, preferably 0.2% by mass or less, particularly preferably 0.16% by mass or less of the total of the composition, the content being a content in terms of the nitrogen element therein. If the component (D) content in terms of the nitrogen element is less than 0.01% by mass, the effect of making the high-temperature detergency higher is small. On the other hand, if the content is more than 0.4% by mass, the low-temperature fluidity of the lubricating oil composition for an internal combustion engine deteriorates largely. Thus, the cases are not each preferred.

In order to make better the performance of the lubricating oil composition for an internal combustion engine of the invention, any additive that is generally used in lubricating oil can be added thereto for the purpose thereof. Examples of such additives include any anti-wear agent other than the component (A), a friction modifier, a viscosity index improver, a corrosion inhibitor, a rust inhibitor, an anti-emulsifier, a metal inactivator, an antifoamer, and a colorant.

Examples of the anti-wear agent other than the component (A) include sulfur-containing anti-wear agents such as zinc dithiocarbamate, disulfides, olefin sulfides, oil and fat sulfides, ester sulfides, thiocarbonates, and thiocarbamates; phosphorus-containing anti-wear agents such as phosphorous acid esters, phosphoric acid esters, and phosphonic acid esters; sulfur- and phosphorus-containing anti-wear agents such as thiophosphorous acid esters, thiophosphoric acid esters, thiophosphonic acid esters, and amine salts or metal salts thereof. Anti-wear agents containing sulfur among these may be incorporated as long as the sulfur content in the composition is not more than 0.2% by mass by the adjustment of the agents in connection with the lubricant base oil or other sulfur-containing additives. It is more preferable that none of the agents are incorporated. Anti-wear agents containing phosphorus among these may be incorporated as long as poisonous harm of phosphorus on exhaust gas purifying catalysts does not become remarkable. The agents may be incorporated, for example, in an amount of 0.04% by mass or less, preferably 0.01% by mass or less, the amount being an amount in terms of the phosphorus element therein. It is more preferable that none of the agents are incorporated.

As the friction modifier, any compound that is usually used as a friction modifier for lubricating oil can be used. Examples thereof include molybdenum-based friction modifiers such as molybdenum dithiocarbamate, molybdenum-amine complexes, molybdenum-succinimide complexes; and ashless friction modifiers, such as amine compounds, aliphatic acid esters, aliphatic acid amides, aliphatic acids, aliphatic alcohols, and aliphatic ether each of which has in the molecule thereof an alkyl or alkenyl group having 6 to 30 carbon atoms, in particular, a linear alkyl group or linear alkenyl group having 6 to 30 carbon atoms. Usually, the adjuster can be incorporated in an amount of 0.1 to 5% by mass. When molybdenum dithiocarbamate is incorporated, it is preferable that the incorporating amount thereof is adjusted in connection with the base oil and other additives in such a manner that the sulfur content in the composition is 0.2% by mass or less, preferably 0.1% by mass or less, particularly preferably 0.05% by mass or less. The use of the ashless friction modifiers among these is particularly preferable since the adjusters do not contain sulfur or metals.

Specific examples of the viscosity index improver include the so-called non-dispersion type viscosity index improvers, which are polymers or copolymers made from one or more monomers selected from various methacrylic acid esters, or hydrogenated products thereof; the so-called dispersion type viscosity index improvers, which are obtained by copolymerizing them further with various methacrylic acid esters containing a nitrogen compound; non-dispersion type or dispersion type ethylene/α-olefin copolymers (examples of the α-olefin including propylene, 1-butene and 1-pentene), or hydrogenated products thereof; polyisobutylene, or hydrogenated products thereof; hydrogenated products of styrene/diene copolymer; styrene/anhydrous maleic acid ester copolymer; and polyalkylstyrene.

It is necessary that the molecular weight of these viscosity index improvers is selected, considering shear stability. Specifically, the number-average molecular weight of the viscosity index improvers is usually from 5,000 to 1,000,000, preferably from 100,000 to 900,000 in the case of, for example, the dispersion type and the non-dispersion type polymethacrylates; is usually from 800 to 5,000, preferably from 1,000 to 4,000 in the case of the polyisobutylene or the hydrogenated products thereof; and is usually from 800 to 500,000, preferably from 3,000 to 200,000 in the case of the ethylene/α-olefin copolymers or the hydrogenated products thereof.

When the ethylene/α-olefin copolymers or the hydrogenated products thereof are used out of these viscosity index improvers, compositions particularly good in shear stability can be obtained. One or more compounds selected at will from the above-mentioned viscosity index improvers can be contained in an arbitrary amount. The content by percentage of the viscosity index improver(s) is usually from 0.1 to 20% by mass of the composition.

Examples of the corrosion inhibitor include benztriazole type, tolyltriazole type, thiadiazole type, and imidazole type compounds.

Examples of the rust inhibitor include petroleum sulfonate, alkylbenzenesulfonate, dinonylnaphthalenesulfonate, alkenylsuccinic acid esters, and polyhydric alcohol esters.

Examples of the anti-emulsifier include polyalkylene glycol type nonionic surfactants such as polyoxyethylene alkyl ether, polyoxyethylene alkyl phenyl ether and polyoxyethylene alkyl naphthyl ether.

Examples of the metal inactivator include imidazolin, pyrimidine derivatives, alkylthiadiazole, mercaptobenzothiazole, benzotriazole or derivatives thereof, 1,3,4-thiadiazole polysulfide, 1,3,4-thiadiazolyl-2,5-bisdialkyldithiocarbamate, 2-(alkyldithio)benzimidazole, and β-(o-carboxybenzylthio)propionitrile.

Examples of the antifoamer include silicone, fluorosilicone, and fluoroalkyl ether.

When these additives are incorporated into the lubricating oil composition of the invention, the content thereof is usually set into the range of 0.005 to 5% by mass of the total of the composition in the case of the corrosion inhibitor, the rust inhibitor or the anti-emulsifier; into the range of 0.005 to 1% by mass thereof in the case of the metal inactivator; and into the range of 0.0005 to 1% by mass thereof in the case of the antifoamer.

The lubricating oil composition for an internal combustion engine of the invention is a low-sulfur lubricating oil composition for an internal combustion engine which does not substantially contain any dithiophosphoric acid metal salt, as described above, and has a sulfur content of 0.2% by mass or less. When a phosphorus-containing anti-wear agent is not used at all, the composition can be rendered a composition which does not substantially contain phosphorus. When the lubricant base oil or various additives therein are selected, the composition can be rendered a low-sulfur lubricating oil composition the total sulfur content of which is preferably 0.1% by mass or less, more preferably 0.05% by mass or less, particularly preferably 0.01% by mass or less, the composition being used for an internal combustion engine. When attention is paid, in particular, to sulfur content contained in mineral oil fractions, as diluting agents, which are contained in the lubricant base oil and various additives, it is also possible to obtain a lubricating oil composition for an internal combustion engine which contains 0.001% by mass or less of sulfur or does not substantially contain sulfur.

In the lubricating oil composition for an internal combustion engine of the invention, its anti-wear agent contains no metal, and sulfated ash content (that does not include boron, which does not correspond to any metal, and) results from metals in the composition can be made lower than that in the case of using a metal-containing anti-wear agent, for example, ZDTP. When the other metal-containing additives or the like are selected, it is possible to set the sulfated ash content resulting from the metals in the composition preferably to 1.0% by mass or less, more preferably to 0.8% by mass or less, even more preferably to 0.7% by mass or less. Thus, the composition is preferable as a lubricating oil for internal combustion engines for DPF-fitted diesel cars.

The lubricating oil composition for an internal combustion engine of the invention comprises the above-mentioned constituents, whereby the composition is a lubricating oil composition for an internal combustion engine which is good in oxidation stability, base number retention property, high-temperature detergency, and the wear prevention of a valve train. The composition can be preferably used as a lubricating oil composition for an internal combustion engine such as a gasoline engine, diesel engine or gas engine of a motorcycle, an automobile, power generation, a ship and others. When the composition is ultimately rendered a substantially phosphorus-free and sulfur-free composition wherein the content of the sulfated ash resulting from metals is set to 0.7% by mass or less, the composition can be particularly preferably used for an internal combustion engine to which an exhaust gas after-treating device is fitted.

The composition can be particularly preferably used as a lubricating oil for an internal combustion engine using a low-sulfur fuel, for example, gasoline, light oil, kerosene, LPG or natural gas having a sulfur content of 50 ppm by mass or less, preferably 30 ppm by mass or less, particularly preferably 10 ppm by mass or less, or a fuel which does not substantially contain any sulfur content (such as hydrogen, dimethyl ether, alcohol, or GTL (gas-to-liquid) fuel, in particular, as a lubricating oil for a gasoline engine or a gas engine.

Moreover, the present invention can be preferably used as a lubricating oil about which any one of the above-mentioned performances is required, a lubricating oil for a driving system such as an automatic or manual transmission driving mechanism, or a lubricating oil such as grease, wet brake oil, hydraulic oil, turbine oil, compressor oil, shaft bearing oil or refrigerator oil.

EXAMPLES

The contents of the present invention are more specifically described by the following examples and comparative examples. However, the invention is not limited by these examples.

(A) Comparison of Basic Performances

<1. Evaluating Test Methods>

Each of a lubricating oil for an internal combustion engine of the invention (Example 1) and a lubricating oil for an internal combustion engine for comparison (Comparative Example 1) was prepared as shown in Table 1.

TABLE 1

| | | | Example 1 | Comparative Example 1 |
|---|---|---|---|---|
| Formulation | Lubricant base oil *1) | % by mass | Balance | Balance |
| | (A) Boric acid ester *2) | % by mass | 1 | — |
| | Amount in terms of boron element | % by mass | (0.05) | — |
| | (B) Ashless antioxidant *3) | % by mass | 1 | 1 |
| | (C) Metal-based detergent *4) | % by mass | 3.3 | 3.3 |
| | Amount in terms of metal elements | % by mass | (0.2) | (0.2) |
| | (D) Ashless dispersant *5) | % by mass | 5 | 5 |
| | Amount in terms of nitrogen element | % by mass | (0.075) | (0.075) |
| | Metal salt of dithiophosphoric acid *6) | % by mass | — | 1.25 |
| | Amount in terms of phosphorus element | % by mass | — | (0.09) |
| | Amount in terms of sulfur element | % by mass | — | (0.2) |
| | Viscosity index improver *7) | % by mass | 4 | 4 |
| | Anti-emulsifier *8) | % by mass | 0.01 | 0.01 |
| Components | Phosphorus content in the composition | % by mass | 0.000 | 0.09 |
| | Total sulfur content in the composition | % by mass | <0.01 | 0.2 |
| | Sulfated ash content resulting from metals | % by mass | 0.67 | 0.83 |
| Performance tests | Hot tube test (best: 10) | 300° C. | 10 | 6 |
| | | 310° C. | 9 | 4 |
| | | 320° C. | 7 | 0 |
| | Base number remaining rate after ISOT test | 48 h % | 74 | 46 |
| | (HCI method) Temperature: 165.5° C. | 96 h % | 64 | 34 |
| | Base number remaining rate after NO*x* absorption | 10 h % | 64 | 53 |
| | test (HCI method) Temperature: 150° C. | 20 h % | 39 | 18 |
| | Valve train wear test (JASO M328-95) | | | |
| | Locker arm pad scuffing area | % | 5.1 | 15.8 |
| | Locker art wear | μm | 1.6 | 1.4 |
| | Cam wear | μm | 2.1 | 5.3 |

*1) Hydrorefined mineral oil, total aromatics content: 5.0% by mass, sulfur content: 0.001% by mass, 100° C. kinematic viscosity: 5.6 $mm^2/s$, viscosity index: 125, NOACK evaporation loss: 8% by mass
*2) Tributyl borate, boron content: 4.8% by mass
*3) Mixture of octyl-3-(3,5-di-tert-butyl-4-hydroxyphenyl)propionate and alkyldiphenylamine (alkyl group: C4 and C8) (ratio by mass = 1:1)
*4) Calcium salicylate, metal ratio: 2.7, calcium content: 6.0% by mass, sulfated ash content: 20.4% by mass
*5) Polybutenylsuccinimide (bis type), number-averagemolecular weight of the polybutenyl groups: 1300, nitrogen content: 1.5% by mass
*6) Zincdialkyldithiophosphate, phosphorus content: 7.2% by mass, sulfur content: 15.2% by mass, zinc content: 7.8% by mass, alkyl group: 1,3-dimethylbylyl group, sulfated ash content: 11.7% by mass
*7) OCP, average molecular weight: 150000
*8) Polyalkylene glycol type Outlines of components used for the formulation of each of the compositions are as follows.

(Basic Oil)

A hydrorefined mineral oil was used. The total aromatic fraction content in the mineral oil was 5.0% by mass, and the sulfur content therein was 0.001% by mass. The kinematic viscosity at 100° C., the viscosity index and the NOACK evaporation loss thereof were 5.6 $mm^2$, 125 and 8% by mass, respectively.

((A) Boric Acid Ester)

Tributyl borate was used in the composition of Example 1. The boron content therein was 4.8% by mass.

((B) Ashless Antioxidant)

Octyl-3-(3,5-di-tert-butyl-4-hydroxyphenyl)propionate and alkyldiphenylamine (alkyl group: C4 and C8) were mixed with each other at a ratio by mass of 1:1, and the mixture was used.

(Metal Salt of Dithiophosphoric Acid)

Zinc dialkyldithiophosphate was used. The zinc salt having a phosphorus content of 7.2% by mass, a sulfur content of 15.2% by mass, and a zinc content of 7.8% by mass was used. The alkyl group thereof was a 1,3-dimethylbutyl group, and the sulfated ash content therein was 11.7% by mass.

((C) Metal-Based Detergent)

Calcium salicylate (containing no sulfur) was used. The metal ratio, the calcium content, and the sulfated ash content were 2.7, 6.0% by mass, and 20.4% by mass, respectively.

((D) Ashless Dispersant)

Polybutenylsuccinimide (bis type) was used. The number-average molecular weight of the polybutenyl groups was 1300, and the nitrogen content was 1.5% by mass.

(Viscosity Index Improver and Anti-Emulsifier)

An olefin (copolymer) copolymer (OCP) was used as a viscosity index improver and a polyalkylene glycol type agent was used as an anti-emulsifier.

About each of the resultant compositions, the performances thereof were evaluated through the following tests.

(1) High-Temperature Detergency Viewed from a Hot Tube Test

A hot tube test was made in accordance with JPI-5S-5599. About the score thereof, a transparent and colorless sample (no stain) was decided as 10 points and a black and opaque sample was decided as a zero point. Reference tubes formed at intervals of one point therebetween were referred to, and the compositions were evaluated. The evaluation results thereof are shown in Table 1. If the score of a composition is 6 points or more at 290° C., the composition has a good detergency for a lubricating oil for ordinary gasoline engines and diesel engines. It is preferable that a lubricating oil for gas engines exhibits a good detergency at 300° C. or higher in the present test, for example, a score of "8" or more at 300° C., a score of "5" or more at 310° C. and a score of "2" or more at 320° C. therein.

(2) Change in the Total Base Number with Time, Based on ISOT (Oxidation Stability of a Lubricating Oil for an Internal Combustion Engine; Indiana Stirring Oxidation Test)

By an ISOT test (temperature: 165.5° C., air blowing amount: 10 L/hour, and catalyst: copper and iron) according to JIS K 2514 "Lubricating Oil—Oxidation Stability Test Method", 4., the test oils were forcibly deteriorated, and during the deterioration a change in the remaining rate of the total base number (hydrochloric acid method) was measured with time. The evaluation results are shown in Table 1. As the total base number remaining rate of an oil versus the time for the test is higher, the base number retention property thereof is higher. Thus, the oil is a long drain oil which can be used for a longer period.

(3) Change in the Total Base Number with Time, Based on a NOx Absorption Test

NOx gas was blown into the test oils under the conditions (150° C., NOx: 1198 ppm) according to Japan Tribology Conference Proceedings 1992, 10, 465, so as to deteriorate the oils forcibly. During the deterioration, a change in the total base number thereof (hydrochloric acid method) was measured with time. The evaluation results are shown in Table 1. As the total base number remaining rate of an oil versus the time for the test is higher, the base number retention property thereof is higher in the presence of such NOx as is used in an internal combustion engine. Thus, the oil is a long drain oil which can be used for a longer period.

(4) Valve Train Wear Test

A valve train wear test according to JASO (Japanese Automobile Standards Organization) M 328-95 was made, and the following were measured: the locker arm pad scuffing area (%), the locker arm wear (μm) and the cam wear (μm) after 100 hours. If a composition has a value of 10 or less about each thereof, the composition is a composition very good in the wear prevention of a valve train. In the present test, gasoline having a sulfur content of 10 ppm by mass or less was used as a fuel.

<2. Evaluation Test Results>

As shown in Table 1, it is understood that the lubricating oil composition for an internal combustion engine of the invention (Example 1) exhibited far better oxidation stability, base number retention property at high temperature and in the presence of NOx, and high-temperature detergency than the lubricating oil composition for an internal combustion engine containing zinc dialkyldithiophosphate, which is generally a conventional long drain oil excellent in oxidation stability, base number retention property, high-temperature detergency and wear prevention (Comparative Example 1), and had a performance entirely equivalent to that of the conventional composition about the wear prevention of a valve train.

(B) Property-Change Before and After the Valve Train Wear Test

About the test oil using the gasoline having the sulfur content of 10 ppm by mass or less before and after the valve train test in the above-mentioned Example A (A), the total acid value increase rates, the viscosity increase rates and the total base number remaining rates of the compositions of Example 1 and Comparative Example 1 were measured and compared. As a result, it was proved that about the composition of Example 1, the total acid number increase rate and the viscosity increase rate thereof were controlled into lower values and the total base number remaining rate thereof was higher than about the composition of Comparative Example 1.

(C) Effect of the Metal Ratio and Others of the Metal-Based Detergent onto Composition Performances The metal ratios of calcium salicylates in Example 1 and Comparative Example 1 were changed or calcium sulfonate was used instead of the calcium salicylates to make the above-mentioned hot tube test, ISOT test, and NOx absorption test, thereby evaluating the oxidation stability, base number retention property, and high-temperature detergency thereof. About the contents of the metal-based detergents in the compositions, the amounts in terms of the metal elements therein were adjusted to be the same.

(1) There was prepared a composition C1 using a calcium salicylate having a metal ratio of 3 or more, specifically 4. 3, instead of the calcium salicylate having the metal ratio of 2.7 in the composition of Example 1. There was also prepared a composition C2 using a calcium salicylate having a metal ratio of 4.3 instead of the calcium salicylate having the metal ratio of 2.7 in the composition of Comparative Example 1. The composition 1 exhibited better oxidation stability, base number retention property and high-temperature detergency than the composition C2. However, the composition of Example 1 exhibited even better performance than the composition C1.

(2) There were prepared compositions C3 and C4 using a calcium salicylate having a metal ratio of 1.5 or less, specifically 1, instead of the calcium salicylate having the metal ratio of 2.7 in the composition of Example 1 or using both of a calcium salicylate having a metal ratio of 1.5 or less and a calcium salicylate having a metal ratio of 2.7 instead of the calcium salicylate in the composition of Example 1, thereby using a calcium salicylate having a metal ratio of 1.8 to 2.3, specifically 2.1. The compositions C3 and C4 exhibited better oxidation stability, base number retention property and high-temperature detergency than the composition of Example 1.

(3) There was prepared a composition C5 using calcium sulfonate having a metal ratio of 10 (sulfur-containing metal-based detergent) instead of the calcium salicylate having the metal ratio of 2.7 and incorporated into the composition of Example 1. There was also prepared a composition C6 using a calcium sulfonate having a metal ratio of 10 (sulfur-containing metal-based detergent) instead of the calcium salicylate having the metal ratio of 2.7 and incorporated into the composition of Comparative Example 1. The composition C5 exhibited better oxidation stability, base number retention property and high-temperature detergency than the composition C6, but exhibited a poorer result about the base number remaining rate than the composition of Example 1. However, it was found out that in the case of a composition C7, which was prepared by using a calcium salicylate having a metal ratio of 1.5 or less, for example, a metal ratio of 1 as an essential component together with a calcium sulfonate having a metal ratio of 10, the base number retention property thereof, in particular, the base number retention property in the presence of NOx was made considerably higher than in the case of the composition C5.

INDUSTRIAL APPLICABILITY

The lubricating oil composition for an internal combustion engine of the invention does not substantially comprise phosphorus, and can exhibit good performances in wear prevention of a valve train, oxidation stability, high-temperature detergency and base number retention property notwithstanding a low sulfur content therein. Thus, the composition can be preferably used as a lubricating oil composition for an internal combustion engine such as a gasoline engine, diesel engine or gas engine of a motorcycle, an automobile, power generation, a ship and others. The composition can be particularly preferably used for an internal combustion engine to which an exhaust gas after-treating device is fitted.

The composition can be preferably used as a lubricating oil for an internal combustion engine using a low-sulfur fuel, for example, gasoline, light oil, kerosene, LPG or natural gas having a sulfur content of 50 ppm by mass or less, or a fuel which does not substantially contain any sulfur content (such as hydrogen, dimethyl ether, alcohol, or GTL (gas-to-liquid) fuel, in particular, as a lubricating oil for a gasoline engine or a gas engine.

Moreover, the composition can be preferably used as a lubricating oil about which any one of the above-mentioned performances is required, for example, a lubricating oil for a driving system such as an automatic or manual transmission driving mechanism, or a lubricating oil such as grease, wet brake oil, hydraulic oil, turbine oil, compressor oil, shaft bearing oil or refrigerator oil.

The invention claimed is:

1. A lubricating oil composition for an internal combustion engine, consisting of:

a lubricant base oil comprising a mineral oil and/or a synthetic oil, wherein a total aromatic content and sulfur content in the lubricating base oil are adjusted to 10% by mass of less and 0.05% by mass or less, respectively;

(A) 0.001 to 0.5% by mass of an ester of boric acid in terms of boron element therein, represented by the following general formula (1) or (2)

(1)

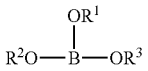

(2)

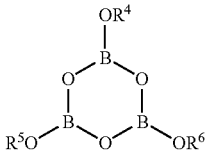

wherein in the general formula (1) and (2), $R^1$ to $R^6$ each may be same or different, each independently represents a hydrocarbon group having 1 to 30 carbon atoms;

and (B) 0.01 to 5% by mass of an ashless antioxidant;

(C) 0.005 to 1% by mass of metal-based detergent in terms of metal element therein; and (D) 0.05 to 0.4% by mass of non-borated bis succinimide in terms of nitrogen element therein;

wherein said composition contains substantially no metal salts of dithiophosphoric acid, has a sulfur content of 0.2% by mass or less, and contains substantially no phosphorus, the metal ratio of the component (C) is 3 or less, the percentage of (A)-(D) and the sulfur content being based on a total mass of the composition.

2. The lubricating oil composition for an internal combustion engine according to claim 1, wherein the component (C) is a metal-based detergent which contains substantially no sulfur.

3. The lubricating oil composition for an internal combustion engine according to claim 1, which has a sulfur content of 0.05% by mass or less, based on the total mass of the composition.

4. The lubricating oil composition for an internal combustion engine according to claim 1, which is for an internal combustion engine using a fuel having a sulfur content of 50 ppm by mass or less.

5. A method for lubricating a valve train of an internal combustion engine consisting of the steps of:

preparing a lubricating oil composition consisting of a lubricant base oil comprising a mineral oil and/or a synthetic oil wherein a total aromatic content and a sulfur content in the lubricating base oil are adjusted to 10% by mass or less and 0.05% by mass or less, respectively, (A) 0.001 to 0.5% by mass of an ester of boric acid in terms of boron element therein, represented by the following general formula (1) or (2)

(1)

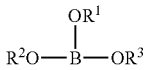

(2)

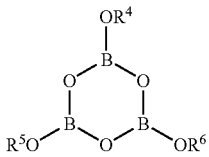

wherein in the general formula (1) and (2), $R^1$ to $R^6$ each may be same or different, each independently represents a hydrocarbon group having 1 to 30 carbon atoms; (B) 0.01 to 5% by mass of an ashless antioxidant, (C) 0.005 to 1% by mass of metal-based detergent in terms of metal element therein; and (D) 0.05 to 0.4% by mass of non-borated bis succinimide in terms of nitrogen element therein; wherein said composition contains substantially no metal salts of dithiophosphoric acid, has a sulfur content of 0.2% by mass or less, and contains substantially no phosphorus, the metal ratio of the component (C) is 3 or less, the percentage of (A)-(D) and the sulfur content being based on a total mass of the composition; and using the lubricating oil composition in lubrication of a valve train of an internal combustion engine.

6. A method for improving long drain performance of a lubricating oil composition for an internal combustion engine consisting of the steps of: adding, into a lubricating oil composition consisting of a lubricant base oil comprising a mineral oil and/or a synthetic oil wherein a total aromatic content and a sulfur content in the lubricating base oil are adjusted to 10% by mass or less and 0.05% by mass or less, respectively, (A) 0.001 to 0.5% by mass of an ester of boric acid in terms of boron element therein represented by the following general formula (1) or (2)

(1)

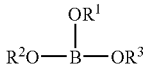

-continued (2)

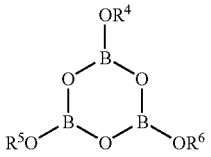

wherein in the general formula (1) and (2), $R^1$ to $R^6$ each may be same or different, each independently represents a hydrocarbon group having 1 to 30 carbon atoms; adding (B) 0.01 to 5% by mass of an ashless antioxidant adding (C) 0.005 to 1% by mass of metal-based detergent in terms of metal element therein; adding (0) 0.05 to 0.4% by mass of non-borated bis succinimide in terms of nitrogen element therein; wherein the metal ratio of the component (C) is 3 or less, the percentage of (A)-(D) being based on a total mass of the composition; consequently providing composition containing substantially no metal salts of dithiophosphoric acid, having a sulfur content of 0.2% by mass or less, and contains substantially no phosphorus, the percentage of the sulfur content being based on a total mass of the composition.

7. The lubricating oil composition for an internal combustion engine according to claim 1,wherein the component (C) is an alkali metal or alkaline earth metal salicylate.

8. The lubricating oil composition for an internal combustion engine according to claim 1, wherein the component (B) is octyl-3-(3,5-di-tert-butyl-4-hydroxyphenyl)propionate.

9. The lubricating oil composition for an internal combustion engine according to claim 1,wherein the component (D) is polybutenylsuccinimide (bis type).

* * * * *